US006554211B1

(12) United States Patent
Prueter et al.

(10) Patent No.: US 6,554,211 B1
(45) Date of Patent: Apr. 29, 2003

(54) CONTAINER VENT CONTROL FOR BATTERY OPERATED SPRAYER

(75) Inventors: David M. Prueter, Olathe, KS (US); William L. Driskell, Lee's Summit, MO (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 10/208,808

(22) Filed: Aug. 1, 2002

(51) Int. Cl.[7] ..... B05B 9/04
(52) U.S. Cl. ..... 239/332; 239/351; 222/333
(58) Field of Search ..... 239/333, 332, 239/351, 375, 329; 222/333

(56) References Cited

U.S. PATENT DOCUMENTS 4,230,277 A * 10/1980 Tada ..... 239/333
5,397,034 A * 3/1995 Wunsch ..... 222/333
5,603,434 A * 2/1997 von Schuckmann ... 222/153.14
5,716,007 A * 2/1998 Nottingham et al. ..... 239/332

* cited by examiner

*Primary Examiner*—Lisa A. Douglas
(74) *Attorney, Agent, or Firm*—Dykema Gossett PLLC

(57) ABSTRACT

A container vent control for a manually operated sprayer has a short flexible tubing section mounted within a cylindrical housing of the sprayer having a vent port. A vent probe on the trigger lever is aligned with the vent port and upon manual pressure applied to the trigger lever collapses or flexes the tubing section so as to be unseated from the vent port and open a vent into the interior of the container

8 Claims, 2 Drawing Sheets

FIG. 1
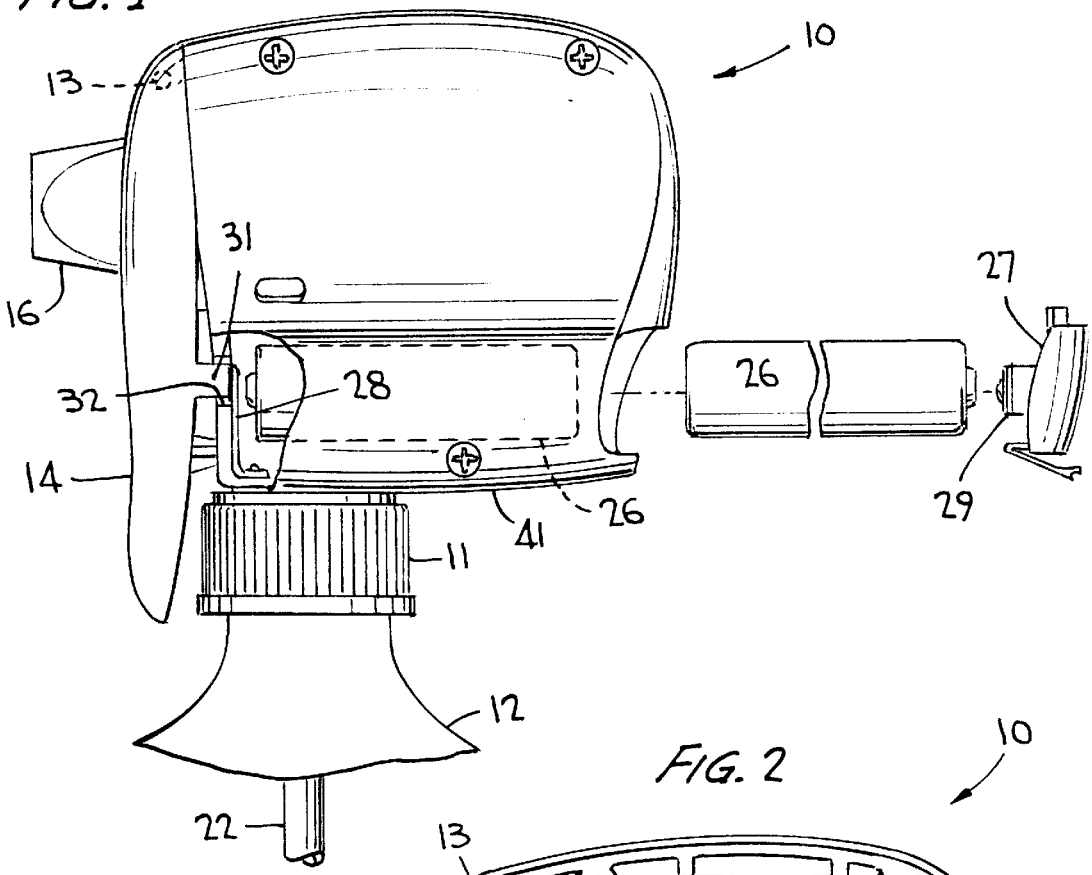
FIG. 2
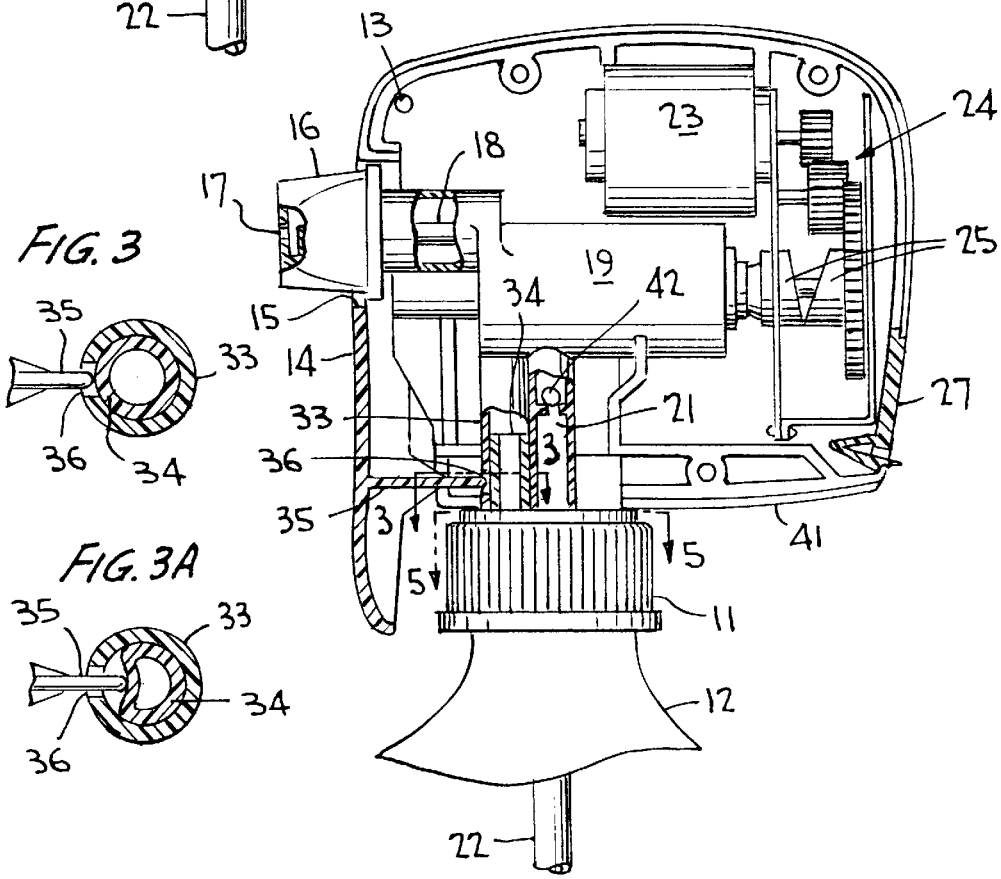
FIG. 3
FIG. 3A

CONTAINER VENT CONTROL FOR BATTERY OPERATED SPRAYER

BACKGROUND OF THE INVENTION

This invention generally relates to manually actuated pump sprayers for mounting to containers of liquids to be sprayed, and more particularly to a trigger operated sprayer having an improved container vent control for opening the vent prior to or after pump activation.

Manually actuated pump sprayers may include trigger sprayers which are well known in the art adapted for manual operation in dispensing of product from a container attached thereto. The container to which the manually actuated pump sprayer is mounted must be vented to atmosphere to replenish the container interior with air as liquid product is dispensed. Otherwise the air volume or head space volume within the container which enlarges as the container is emptied of product eventually becomes sub-atmospheric thereby creating unwanted conditions of hydraulic lock and container collapse. Container venting is carried out in a multitude of ways, utilizing both active and passive valving. Otherwise, container vent control is avoided when using, for example, a collapsible bag as the container of product is dispensed.

Container vent valving must be controlled such that during periods of shipping and storage and other periods of non-use, the vent port remains sealed closed to avoid the possibility of leakage. And, at the same time, the vent valve control must be efficient and economical in use, fabrication and assembly.

Among conventional trigger sprayers having a container vent control is one with a flexible seal member for covering a vent hole to prevent leakage of product and to permit venting of the container during dispensing. Heretofore, conventional seal designs have been quite complex and have thus required relatively complicated manufacturing and assembly techniques. For example, conventional vent seals disclosed in U.S. Pat. No. 4,230,277 includes non-geometric or complex geometric cross-sections, or protrusions or the like integrally molded therewith as in, for example, U.S. Pat. No. 5,603,434. The fabrication and installation of such complex prior art designs can significantly increase the overall manufacturing and assembly costs of the trigger sprayer which can be sizeable.

Moreover, conventional manually activated pump sprayers, whether of the manual pumping type or of the battery activated type, requiring container vent control, can be improved to reduce the number of parts and save costs in manufacturing and assembly and to improve ease of operation.

SUMMARY OF THE INVENTION

The container vent control provided by the invention relies on a reduced number of parts which optimizes operation and economizes in manufacturing and assembly, yet performs in a highly efficient manner for maintaining a tight sealing integrity of the vent port during periods of non-use while allowing quick and easy opening during a spraying operation.

In accordance with the invention, a short, tubular flexible seal mounted within the manually actuated sprayer overlies the vent port in a tightly sealed normally closed position. A rigid probe on the pump actuator aligns with the vent port and is spaced from the seal in a vent closed position. The manual actuator is hingedly mounted to the sprayer for movement of the probe from a relaxed position into the port to engage the tubular seal for unsealing the vent port in a vent open position to vent the container.

The container vent control provided for the manually operated sprayer is suitable for both a trigger actuated pump sprayer having a reciprocable pump piston within a cylinder, the piston being actuated by manual operation of a trigger lever. And, the invention is suitable for a battery operated sprayer having an electric motor for operating the pump, a battery for operating the motor, and a manually operated switch for selectively connecting and disconnecting the motor and the battery.

Other objects, advantages, and novel features of the invention will become more apparent from the following detailed description of the invention when taken in conjunction with the accompanying drawings.

BRIEF DESCRIPTION OF THE DRAWINGS

FIG. 1 is a side elevational view of a battery operated sprayer incorporating the invention;

FIG. 2 is a vertical sectional view of the battery operated sprayer of FIG. 1 showing the container vent control according to the invention in detail;

FIG. 3 is an enlarged sectional view taken substantially along the line 3—3 of FIG. 2;

FIG. 3A is a view similar to FIG. 3 showing a portion of the container vent valve moved away from its valve seat to open the vent;

DETAILED DESCRIPTION OF THE INVENTION

Figure 6:
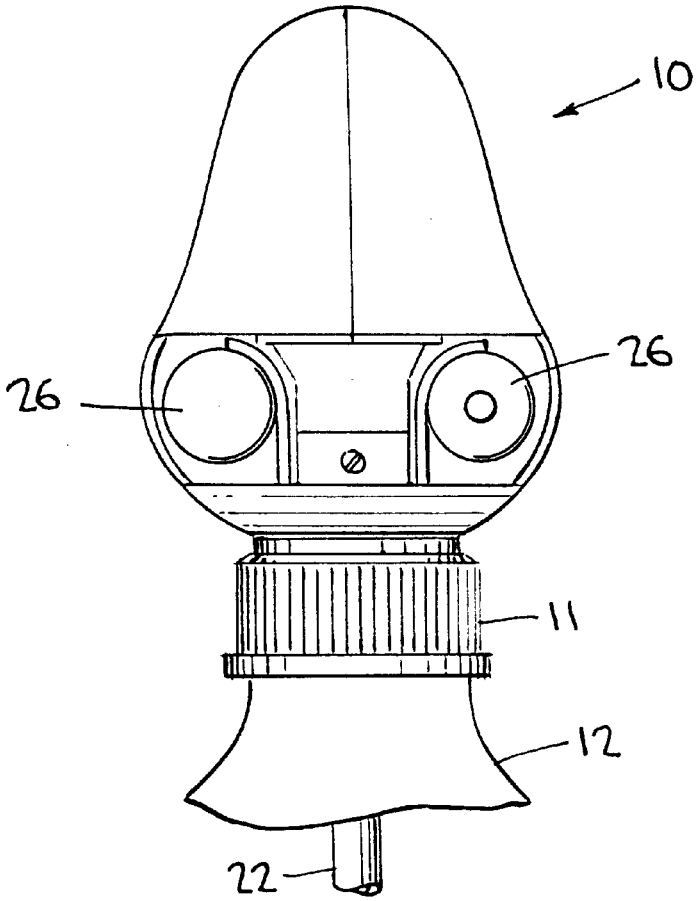
FIG. 6 is an end view of the sprayer of FIG. 1.

Turning now to the drawings wherein like reference characters refer to like and corresponding parts throughout the several views, a battery operated trigger actuated pump sprayer generally designated 10 is shown in FIG. 1 as having coupled thereto a container closure 11 for mounting the sprayer to a container 12 of liquid product to be sprayed. The sprayer has hingedly mounted thereto as at 13 an actuator which may comprise a trigger lever 14 having an opening 15 (FIG. 2) through which a discharge nozzle cap 16 extends having a discharge orifice 17 formed at the terminal end of a discharge passage 18 of the sprayer. Pump 19 has a variable volume pump chamber (not shown) into which an inlet passage 21 extends from the inlet tube 22 which extends into the bottle. The pump is operated by an electric motor 23 via gearing 24 and cams 25 in a manner similar to that disclosed in U.S. Pat. No. 5,716,007, the entirety of which disclosure is incorporated herein by reference. A pair of batteries 26 (FIGS. 1 and 6) housed within suitable compartments of the sprayer are insertable from the rear end thereof as shown in FIG. 1. A battery cover 27 covers the outer end of the batteries and is snap-fitted in place to the sprayer as shown. It is to be noted that the battery cover is omitted in FIG. 6 for clarity of the drawing.

A metallic switchplate 28 is mounted to the sprayer as having an upstanding spring leg of typical design such that when depressed into contact with the positive side of the battery shown mounted in the sprayer in FIG. 1, the switch to the motor is closed via a metallic contact plate 29 on the switchplate which spans the batteries in a known manner for completing the circuit.

Trigger lever 14 has a rearwardly extending rigid probe 31 (FIG. 1) which may extend into an opening 32 formed in the front wall of the sprayer at some predetermined distance from or in light contact with switchplate 28 in the relaxed position of the trigger lever shown in FIG. 1.

Figure 4:
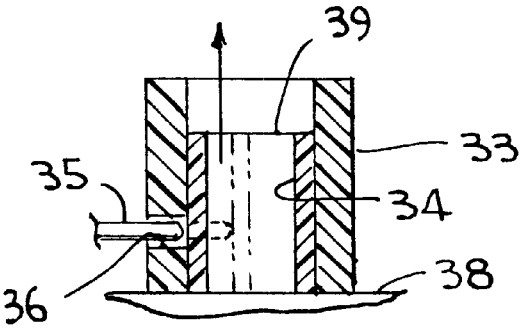
FIG. 4 is an enlarged vertical sectional view of the vent tubing mounted in place and illustrating the venting function.
Figure 5:
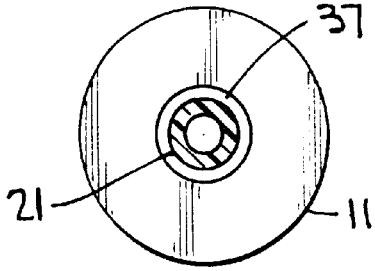
FIG. 5 is a view taken substantially along the line 5—5 of FIG. 2.

In accordance with the container vent control valving of the invention, at a lower end at the interior of the sprayer within the footprint of the container closure is provided a valve housing in the form of a short cylinder 33 or the like as more specifically shown in FIGS. 3, 3A and 4. And, housing 33 may be located in front of inlet pipe 21 and in alignment with the longitudinal axis of the trigger lever.

Another rigid probe 35 may be integrally formed on the trigger lever extending in a rearward direction in alignment with an opening 36 located in cylindrical housing 33. In the relaxed condition of the trigger sprayer shown in FIG. 2, the rigid probe 35 may extend partially into opening 36 as shown more clearly in FIG. 3. The length of probes 31 and 35 and their respective relationship to the positive end of the confronting battery and the tubular valve, is such that the vent valve is opened prior to the closing of the battery circuit to operate the motor. However, it should be pointed out that, without departing from the invention, the probe length and their respective relationship to the positive end of the confronting battery and the tubular valve, could alternatively be such that the closing of the battery circuit to operate the motor is effected prior to the opening of the vent valve.

Opening 36 in cylindrical housing 33 comprises a vent port which is sealed closed by tube 34 in the position shown in FIGS. 3 and 4 and which is opened to atmosphere in a position shown in FIG. 3A and in phantom outline in FIG. 4. A vent passage to the interior of the container extends via the upper free end of cylindrical housing 33 and spacing 37 which directly communicates with the interior of the container. The vent passage terminates in vent port 36.

In operation, during shipping and storage and other conditions of non-use, vent port 36 is fluid tightly sealed closed by flexible tube 34 which, in the FIGS. 2, 3 and 4 position, seats tightly against the inner wall of cylindrical housing 33 to close the vent port. One hand of the operator typically surrounds the upper end of the bottle and its closure 11 while the underside 41 of the sprayer rests on the top of the hand for supporting the weight of sprayer package. On exerting a manual pull on trigger lever 14 by one or two fingers which extend about the front face of the lever, probe 35 connected to lever 14 moves literally from its position at rest of FIG. 3 to its position of FIGS. 3A and 4 at which probe 35 bears against flexible tube 34 so as to flex or collapse the confronting tube wall whereupon the collapsed wall portion moves away from vent port 36 to thereby open the interior of the bottle to atmosphere via the open vent. Since tube 34 is seated within cylindrical housing 33 which is essentially formed with a bottom wall 38 (FIG. 4), and since vent port 36 is adjacent free upper end 39 of tube 34, that portion of the tube confronting vent port 36 flexes or collapses from an area between vent port 36 and free end 39, as shown in phantom outline in FIG. 4, so that air from outside cylindrical housing 33 enters the vent port, flows in an upward direction shown by the arrow in FIG. 4 and then flows downwardly through spacing 37 via closure 11 and into container 12 to replace product dispensed with air to avoid container collapse and any hydraulic lock of the pump piston.

After a slight delay following the opening of the container vent port as aforedescribed, probe 31, attached to the trigger lever, likewise shifts transversely and bends springy switchplate 28 until it contacts the battery pole of the confronting battery 26 whereupon the battery circuit to the motor is complete via connecting plate 29 to operate the motor which turns the gears which operates the pump for pumping liquid product which is drawn up through the dip tube, the inlet passage, the inlet valve 42, and into the pump chamber and out through the discharge valve (not shown) in the discharge passage and finally the discharge orifice 17. The vent port remains open in the condition of FIGS. 3A, 4 while switchplate 28 remains in contact with the pole of the confronting battery 26 as urged by probe 31 as aforedescribed. On release of inward manual pressure applied to the trigger lever, the lever pivots about hinge 13 outwardly away from the front end of the sprayer back into its relaxed or non-use position of FIGS. 1, 2 and 3. Since the probe 35 is of a predetermined length that its tip extends into port 36 and lies at or near the outer surface of tube 34 in the non-use position, and since probe 31 in the non-use position contacts spring switchplate 28 which is spaced a predetermined distance from the pole of the confronting battery 26, as shown in FIG. 1, a delay is assured between the opening of the container vent followed by the pumping operation.

From the foregoing, it can be seen that a simple and efficient yet highly effective container vent control has been provided for the pump sprayer. Tube 34 of flexible material may be elastomeric and may be hollow as described or of solid material within the scope of the invention. In any event the tube comprises a short tube section which can be simply cut from a length of standard tubing which is available from some suitable supply. The tubing may be of plastic of rubberized material so long as it is flexible and capable of returning to its original position such as that shown in FIG. 3 after the removal of probe pressure applied to a side thereof. The container vent port is designed to be adjacent the top free end of the tubing section so that when collapsed by the probe, an air passage is opened from outside the cylindrical housing via the vent port and upwardly into the interior of the sprayer and downwardly through spacing at the upper end of the container closure, through the closure and into the interior of the container. No separate return spring is required for the trigger lever since both the tube 34 and spring switchplate 28 provide sufficient resilient bias to the trigger to return it to its relaxed position of non-use after releasing external manual force on the trigger.

It can be seen that the vent tube is simple to sub-assemble and is highly economical as it may be cut from a standard off-the-shelf elongated tubing.

Obviously, many modifications and variations of the present invention are made possible in the light of the above teachings. For example, the container vent control according to the invention is not restricted to a battery operated sprayer but is likewise applicable to a pump sprayer having a pump piston manually reciprocable within a pump cylinder of the type well known in the art. Also the invention is not restricted to the components illustrated for carrying out a battery powered operation for the trigger sprayer, as other known battery systems are likewise available without departing from the invention. It is therefore to be understood that within the scope of the appended claims the invention may be practiced otherwise than as specifically described.

What is claimed is:

1. A manually operated sprayer for a container of liquid to be sprayed, comprising, variable volume pump means having liquid inlet means for connecting the pump means with liquid in the container, outlet means connecting the pump means with a discharge opening, a manual actuator for activating the pump means for pumping liquid from the container through the outlet means and the discharge opening, the sprayer having means defining a container vent passage establishing communication between atmosphere and the interior of the container, the vent passage terminating in a vent port, a flexible tubular seal normally sealing the vent port closed in a vent closed position, the manual actuator having a rigid first probe aligned with the vent port and spaced from the seal in the vent closed position, the manual actuator being hingedly mounted to the sprayer for movement of the probe from a relaxed position into the port to engage the tubular seal for unsealing the vent port into a vent open position for venting the container.

2. The sprayer according to claim 1, wherein the manual actuator comprises a trigger lever which is normally returned to the relaxed position by the flexible seal upon release of manual pressure applied to the lever.

3. The sprayer according to claim 1, wherein the seal comprises a tube of elastomeric material.

4. The sprayer according to claim 1, wherein the sprayer includes electric motor means for operating the pump means, battery means for operating the motor means, and manually operable switch means for selectively connecting and disconnecting the motor means and the battery means.

5. The sprayer according to claim 4, wherein the manual actuator has a rigid second probe for operating the switch means after the first probe unseals the vent port into the vent open position.

6. The sprayer according to claim 5, wherein the manual actuator comprises a trigger lever.

7. The sprayer according to claim 1, wherein the vent port lies adjacent a free end of the vent seal for opening the container interior to atmosphere.

8. The sprayer according to claim 4, wherein the manual actuator has a rigid second probe for operating the switch means, the first and second probes being arranged relative to the vent seal and to the switch means, respectively, to effect opening of the vent port before activating the switch means.

* * * * *